US005928579A

United States Patent [19]

Spahlinger et al.

[11] Patent Number: 5,928,579

[45] Date of Patent: Jul. 27, 1999

[54] APPARATUS AND METHOD FOR SPINNING AND WINDING MULTIFILAMENT YARNS

[75] Inventors: Jorg Spahlinger, Wermelskirchen; Johannes Bruske, Remscheid, both of Germany

[73] Assignee: Barmag AG, Remscheid, Germany

[21] Appl. No.: 08/982,594

[22] Filed: Dec. 2, 1997

[30] Foreign Application Priority Data

Dec. 2, 1996 [DE] Germany ..... 196 49 791
Mar. 8, 1997 [DE] Germany ..... 197 09 608

[51] Int. Cl.[6] ..... D01D 5/12; D02G 3/00; D02J 1/22

[52] U.S. Cl. ..... 264/40.1; 28/220; 28/240; 28/247; 28/290; 242/150 R; 242/151; 242/154; 264/103; 264/210.8; 264/211.12; 425/66; 425/135; 425/377; 425/382.2; 425/404

[58] Field of Search ..... 264/40.1, 103, 264/210.8, 211.12; 425/66, 135, 377, 382.2, 404; 28/220, 240, 247, 290; 242/150 R, 151, 154

[56] References Cited

U.S. PATENT DOCUMENTS 3,743,202 7/1973 Hoffsommer et al. .
5,029,762 7/1991 Behrens et al. .
5,238,202 8/1993 Sheehan et al. ..... 242/150 M
5,343,601 9/1994 Schippers .
5,526,995 6/1996 Westrich et al. .
5,621,637 4/1997 Spahlinger .

FOREIGN PATENT DOCUMENTS 4 781 10/1979 European Pat. Off. .
644 282 3/1995 European Pat. Off. .
40 33 960 5/1991 Germany .
42 03 076 8/1993 Germany .
WO 96/09425 3/1996 WIPO .

*Primary Examiner*—Leo B. Tentoni
*Attorney, Agent, or Firm*—Alston & Bird LLP

[57] ABSTRACT

An apparatus and method for melt spinning a plurality of downwardly advancing multifilament polymeric yarns, and winding the advancing yarns into respective packages. Each of the advancing yarns is brought into contact with a separate yarn delivery mechanism which acts to control the yarn tension before the yarn is wound into a package. Thus, the yarn tension of all of the yarns can be made substantially the same when they are wound into packages, which permits all of the packages to have the same winding structure and the same packing density.

29 Claims, 9 Drawing Sheets

APPARATUS AND METHOD FOR SPINNING AND WINDING MULTIFILAMENT YARNS

BACKGROUND OF THE INVENTION

The present invention relates to an apparatus and method for spinning and winding continuous filament yarns of synthetic high polymer plastics.

In the production of multifilament polymeric yarns, it is conventional to extrude the melt through a spinneret to produce a plurality of downwardly advancing bundle of filaments, to gather the filaments into a yarn which continues to advance downwardly, and to then wind the advancing yarn into a cross wound package. Typically, a number of yarns are processed in a side by side relationship, and the yarns are wound onto respective bobbin tubes which are coaxially mounted on a common winding spindle.

An apparatus and method of the described type are known from DE 42 03 076 and corresponding U.S. Pat. No. 5,343,601. As disclosed in these patents, the yarns are removed from the spinning zone at a high take-off speed by means of a yarn delivery mechanism. The delivery mechanism consists of two godets, around which the yarns partly loop. A yarn tension is built up in the yarns above the godets and causes the yarns to be drawn. The tension at which the yarns are wound is lower than the tension built up for drawing purposes.

In the known apparatus and method, the yarn tension is reduced due to the fact that the delivery mechanism is driven at a circumferential speed which is greater than the yarn running speed. A yarn tension level which is low for winding is therefore set immediately after the yarn runs off the last godet. The yarns are guided to the individual winding stations of the winding device after running off the godet.

The above process entails a problem in that each yarn has a specific yarn tension which is dependent upon the yarn course. Because they are deflected to a greater or lesser degree after leaving the spinning zone, the yarns already have varying tensions upon entering the delivery mechanism. The yarns are brought closer to each other before running onto the delivery mechanism and then spread apart after leaving the latter in order to be guided to the respective winding position. This is especially true in spinning plants where a high number of yarns are simultaneously spun in parallel in the spinning zone, and it results in significant variations in yarn tension between the individual winding positions. These differences in yarn tension give rise at the winding positions to packages of widely differing quality.

Also known from the PCT patent application WO 96/09425 are a method and an apparatus in which two long godets permitting a parallel yarn course are disposed before the winding device. Godets of a length in excess of 120 cm consequently have to be used for spinning apparatus with eight and more yarns spun at the same time. In order to be able to feed the yarns, the godets are mounted only on one side in a projecting manner on a carrier. This means that long godets of this kind can only be used with an average yarn speed. When yarn speeds exceed 6,000 m/min. and the godet diameter is in the range from 100 to 150 mm, the godets have to be driven at speeds of up to 20,000 rpm, which entails considerable problems in terms of service life.

It is accordingly an object of the present invention to provide an apparatus and method for spinning and winding continuous multifilament yarns, wherein the yarns are wound with a preselectable yarn tension in each winding station and at a high yarn speed.

SUMMARY OF THE INVENTION

The above and other objects and advantages of the present invention are achieved by the provision of an apparatus and method of the described type and wherein the yarn tension of each of the advancing side by side yarns is separately controlled immediately upstream of the winding operation. This may be achieved by the provision of a plurality of yarn delivery mechanisms positioned upstream of the winder, with the mechanisms operatively associated with respective ones of the yarns.

The advantage offered by the invention lies in the possibility of eliminating the individual influences on the tension of a yarn which can occur from spinning to winding, such as, e.g. during cooling, processing, twisting, heating or yarn guidance. A yarn tension force which is determined by the delivery mechanism associated with the yarn can be set for each yarn independently of the adjacent yarns. The yarn can be wound with a tension which produces optimum package build-up, particularly for winding. When producing dyed yarns of different colors, for example, the yarns have different properties which also have different effects when winding in different packages. However the method according to the invention enables the same package qualities to be produced at each winding station.

When producing yarns having essentially the same physical properties, the object is to wind the yarns with the same yarn tension. This object can be achieved by means of the particularly advantageous development of the method according to the invention. A package having the same winding structure and the same packing density can therefore be wound at each winding station.

A particularly advantageous variant of the method enables the yarns to be guided with a high tension until just before they enter the winding zone. This guarantees reliable godet operation for drawing the yarn, with little risk of lap formation when running off the godet.

By controlling or regulating the delivery mechanisms in accordance with the yarn tension measured in the yarn course before the delivery mechanisms, it is possible to react directly to variations during the process. The control or regulation can be carried out by means of the variable circumferential speed or the variable yarn looping.

The development of the invention based on measuring the prevailing yarn tension in the yarn course after the delivery mechanism has the advantage of also compensating for the variations in yarn tension originating from the winding operation, such as, e.g. traversing. It is in particular also possible to compensate for the reduction in yarn tension when changing the yarn from the full package to the empty tube. In this case a yarn brake is used to build up a greater yarn tension, as described in DE 40 33 960. A high level of running reliability and catching reliability is thus achieved when carrying out a bobbin change.

In order to keep expenditure for adjusting the individual delivery mechanisms to a minimum, it is advantageous to control the delivery mechanisms in accordance with the yarn tension of a reference point. Should the yarns be spread apart when running off a godet disposed before the winding zone in order to reach the individual winding stations, the yarns which lie on the outside and are therefore deflected the most have a higher yarn tension level than those in the middle. In this respect it is advantageous to locate the reference measurement point in the course of one of the middle yarns.

The method may, however, also be modified so that a certain yarn tension level is predetermined in order, for example, to obtain a certain winding quality.

The variant in which the delivery mechanisms are formed by two driven rollers around which the yarn loops in the shape of an S is particularly suitable for reducing the yarn tension, so that the latter is at a lower level in the yarn course after the delivery mechanisms than before the delivery mechanism. The two delivery rollers may also be disposed in relation to one another such that the yarn loops around them in the shape of a Z.

The variant of the method in which the delivery mechanisms are formed by two non-driven rollers around which the yarn loops in the shape of an S is particularly suitable for increasing the filament tensile force in the winding zone.

The method according to the invention is suitable for achieving fully or partially drawn yarns (FOY or POY) in one operation. All kinds of yarn materials such as polypropylene, polyester, polyamide and viscose can in this respect be advantageously spun and wound according to this method.

The invention also offers the advantage of the yarn tension measurement simultaneously serving to monitor the yarn quality, as described in EP 0644 282. In this case the measurement signals obtained in particular in the yarn course before the delivery mechanism could serve to influence the actual run of the process in the spinning zone and in the drawing zone.

According to a particularly advantageous development of the apparatus, the delivery mechanisms are connected to the machine frame of the winding device. It is thus possible to set a yarn tension in the yarn directly before it enters the head yarn guide of the winding device. Moreover, the operability of the delivery mechanisms can be linked with the operation of the winding device. A person responsible for operating the winding device could directly influence the quality of the wound packages through the operation of the delivery mechanisms.

In addition, by disposing the delivery mechanisms directly before the head yarn guide, the yarn oscillations resulting from the traversing movement can only continue as far as the delivery mechanism. It has already emerged that a delivery mechanism with a driven delivery roller around which the yarn partly loops has improved the quality of the wound yarn, in particular its ability to absorb dye. The delivery roller around which the yarn loops is in this case driven at a circumferential speed which is greater than the yarn running speed. In this connection slippage occurs between the yarn and the circumference of the delivery roller and reduces the yarn tension. However the delivery roller could also be driven such that its circumferential speed is lower than the yarn running speed. This produces braking effects which increase the yarn tension when winding.

Another preferred variant is formed by a delivery mechanism with three driven delivery rollers. An apparatus of this kind is particularly suitable for reducing high yarn tensions. It is thus possible to produce packages with a very low yarn tension level.

In order to influence the setting of the yarn tension within the delivery mechanism, it is advantageous to construct at least one of the rollers such that it can be moved into or out of the yarn course. It is thus possible to influence the angle of loop on the rollers and hence the frictional conditions between the yarn and the respective surfaces of the delivery rollers.

Furthermore, a spinning apparatus wherein the delivery mechanism can assume a non-operating position in which the yarn tension is not influenced, has the advantage of the possibility of the yarns being fed into the delivery mechanisms in a simple manner. The delivery rollers may in this case comprise a conical feed slope provided at the circumference for assistance in moving to its operating position.

In another, particularly advantageous development of the invention the delivery rollers of the delivery mechanism are driven independently of one another. This produces another parameter for varying the setting of the tension in the yarn. The rollers can in this case be driven by means of individual motors or via group drives. The individual motor drive is of advantage if significant differences in yarn tension occur in the individual yarns spun side by side.

When the yarns run essentially parallel to one another, the delivery rollers of adjacent delivery mechanisms may preferably be driven by a group drive.

If the delivery mechanisms are directly connected to the winding device, it is particularly advantageous to integrate the delivery mechanisms into the operating cycle of the winding device. This means that when a bobbin change is carried out the delivery mechanisms can be directly controlled via the control unit of the winding device such that the yarn does not become slack, for example, when changing over.

As a result of controlling or regulating the delivery mechanisms in accordance with the measured yarn tension in the yarn course before the delivery mechanism, it is possible to react directly to variations during the process.

BRIEF DESCRIPTION OF THE DRAWINGS

Further features, advantages and possible applications of the present invention will become apparent from the following description of several specific embodiments, when considered in conjunction with the drawings, in which.

DETAILED DESCRIPTION OF THE PREFERRED EMBODIMENTS

Figure 1:
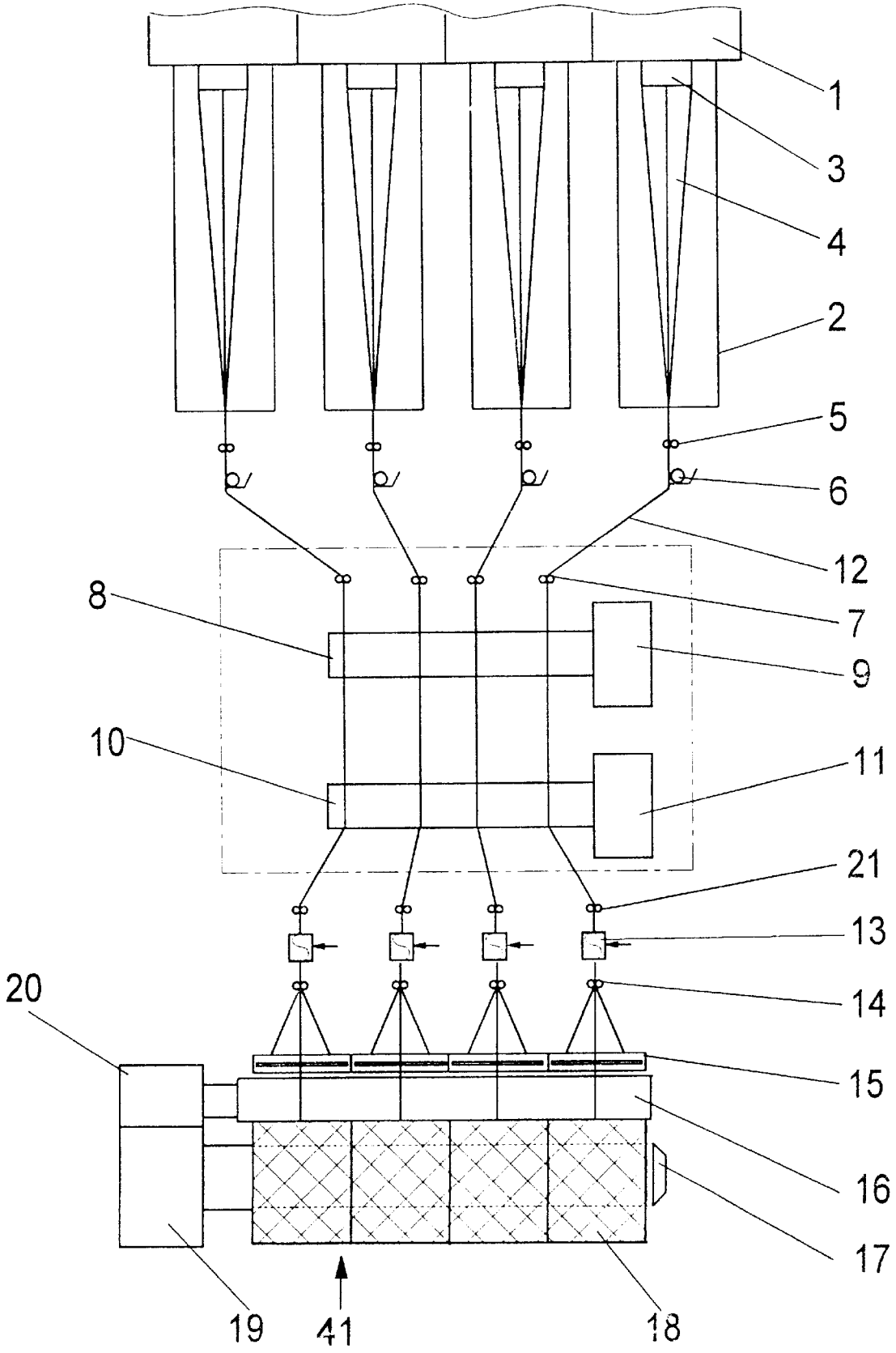
FIG. 1 is a diagrammatic view of a first embodiment of a spinning apparatus according to the invention.

FIG. 1 shows in diagrammatic form a spinning apparatus for carrying out the method according to the invention. A molten polymer is supplied to the spinning head 1 by means of an extruder. The polymer is then conveyed by a spinning pump to a spinneret 3 and spun via numerous holes in the spinneret 3 into a plurality of filaments which form a bundle 4 of downwardly advancing filaments. The illustrated spinning plant has a total of four spinning stations. As each yarn produced at each spinning station is treated in the same way, the process is described below on the basis of one yarn course.

After the filament bundle 4 has left the spinneret 3, the filament bundle 4 passes through a cooling chamber 2. The filament bundle 4 is in the process preferably cooled with quench air. Following cooling, the filament bundle 4 is brought together to form a multifilament yarn 12 at the guide 5. The yarn 12 then passes through a processing device 6 in order to produce a finished yarn. The processing device 6 could also take the place of the yarn guide 5, in which case the yarn guide 5 would be dispensed with. The yarn 12 is subsequently guided into a drawing zone, which is formed by the godets 8 and 10. In FIG. 1, the drawing zone is marked by dot-dash lines. As the width of the spinning zone of the spinning stations disposed in parallel side by side is greater than the width of the running surface of the godet 8, the yarns must be deflected to a respective yarn guide 7 to a greater or lesser degree in accordance with their position in order to pass across the godets 8 and 10 in parallel. The godet 8 is driven by the godet motor 9, and the godet 10 is driven by the godet motor 11. Here the godet 10 is driven at a higher circumferential speed than the godet 8. The yarn 12 loops around the godets 8 and 10 in the shape of an S or a Z. In this drawing zone formation the godet 8 is heated in order to heat the yarn.

It is, however, also possible to dispose a heating device between the processing device 6 and the godet 8 in order to draw and set the yarn. The heating device may in this case be formed as a straight heating tube or as a heating rail.

After the yarn has run off the godet 10, the yarn 12 is guided by the yarn guide 21 to a head yarn guide 14. The stationary head yarn guide 14 belongs to one of a total of four winding stations 41 of a winding device. In each winding station 41 the yarn passes through a traversing device 15, which lays the yarn 12 to-and-fro essentially transversely to the yarn running direction along a traversing stroke. The traversing device 15 may be formed as a vane-type traversing device or as a reversing threaded shaft traversing device. The so-called traversing triangle forms between the traversing device 15 and the head yarn guide 14. The yarn then runs onto a pressure roll 16 which is disposed after the traversing device and is rotatably mounted in the machine frame 20. The yarn loops partly around the pressure roll 16, which is then deposited on the package 18. The package 18 is coaxially mounted on a winding spindle 17. The winding spindle 17 is driven by means of the spindle motor 19, which is regulated in accordance with the circumferential speed of the pressure roll 16 such that the circumferential speed of the package is always constant, so that the yarn is wound with a constant winding speed.

Since the winding spindle 17 is longer than the godet 10, the yarns 12 have to be deflected to a greater or lesser degree after running off the godet 10 in order to enter the respective winding station in parallel. As it is only possible to bring the yarns together before the godet 8 and move them apart after the godet 10 with the aid of yarn guides 7 and 21, a frictional force dependent upon the degree of deflection is produced in the yarn 12. Different yarn tensions are thus built up in each yarn. Where a high-quality yarn is concerned, however, the yarn has to be wound into a package with an essentially constant yarn tension. According to the invention the yarn 12 passes through a respective delivery mechanism 13, the operating mode of which is described below. The delivery mechanism 13 is disposed between the yarn guide 21 and the head yarn guide 14. A yarn tension is reduced or built up in the yarn 12 by means of the delivery mechanism 13. The yarn tension is reduced in the spinning plant shown in FIG. 1. In this case the delivery mechanisms 13 in each yarn course are set such that the yarns exhibit essentially the same yarn tension in the yarn course after the delivery mechanism 13. The reduction in tension is therefore greater in the outer yarns, on account of the greater deflection, than in the middle yarns. Each of the delivery mechanisms thus has a predetermined setting which is dependent on the yarn course.

The method described in FIG. 1 is advantageously used to produce POY. However in this case it is also possible to take the yarns directly out of the spinning zone and to the winding device without the interposition of a drawing system (godets). The structure of the spinning apparatus would correspond to the spinning apparatus from FIG. 1 without the drawing zone marked by dot-dash lines. The yarns pass through the respective delivery mechanisms to set the yarn tension before they enter the winding devices. The yarns are advantageously guided in parallel out of the spinning zone until they reach the delivery mechanisms.

Figure 2:
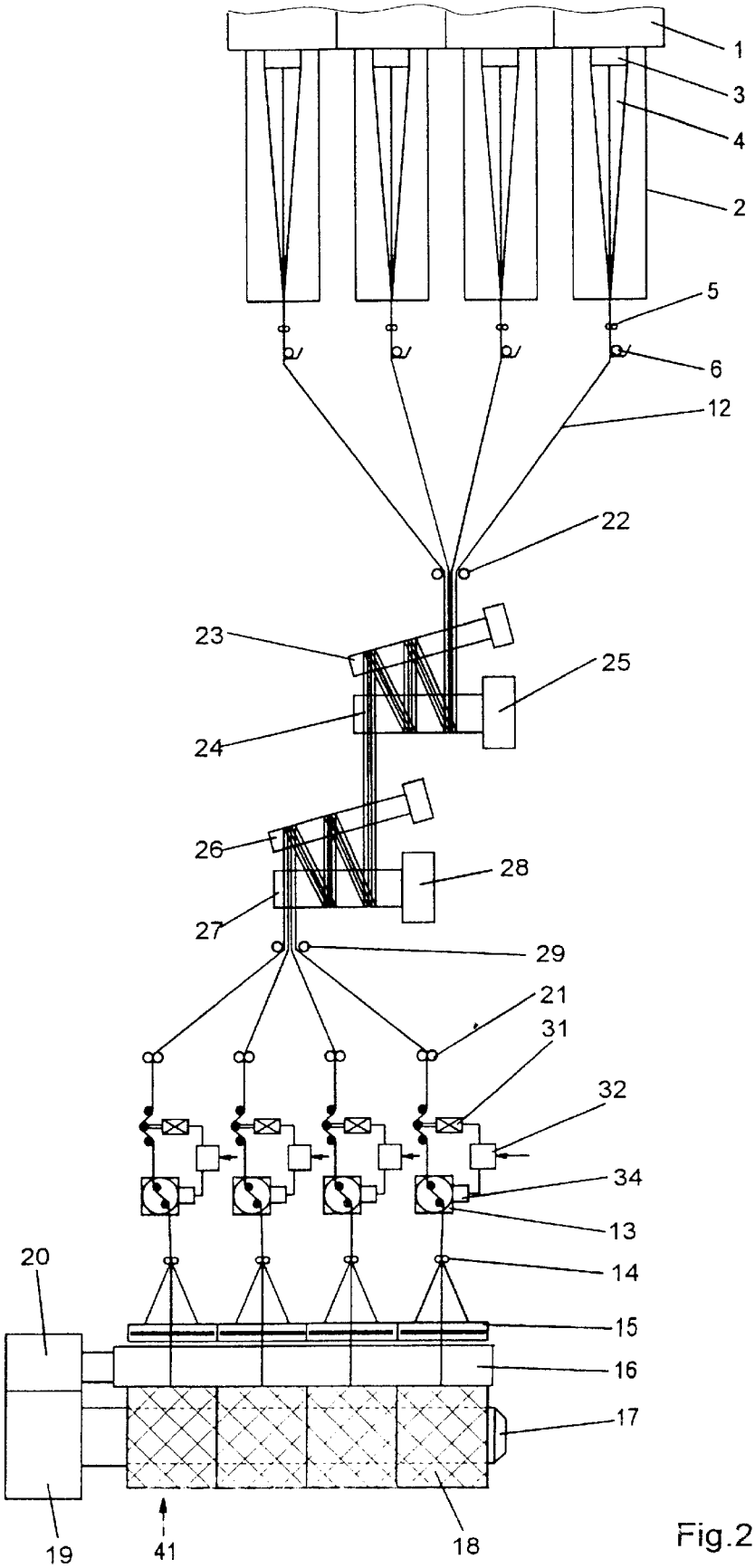
FIG. 2 is a diagrammatic view of a second embodiment of a spinning apparatus according to the invention.

FIG. 2 shows a spinning apparatus which is particularly suitable for producing FDY (fully drawn yarn). As the method cycle from spinning to winding is similar to the spinning method illustrated in FIG. 1, only the differences with respect to the method and the apparatus according to FIG. 1 are described at this point. Otherwise the description relating to FIG. 1 will be referred to.

After leaving the spinning zone, the yarns 12 are brought toward each other such that they can run onto the godet 24 at a slight distance from one another. A yarn guide 22 disposed before the godet 24 serves this purpose. The yarns 12 loop around the godet 24 several times, being guided to-and-fro between a transfer roller 23 and the godet 24. The yarns are taken off the godet 24 by a drawing godet 27, and the yarns 12 then loop several times around the godet 27 and the transfer roller 26. The feed godet 24 is driven by the godet motor 25, and the drawing godet 27 is driven by the godet motor 28. The godet 27 is driven at a higher circumferential speed than the godet 24 in order to draw the yarns. Here too the godet 24 is heated in order to heat the yarns. However the method can also be carried out with cold godets. A heating tube or heating rail is used for the heating process between the feed godet 24 and the processing device 6. However the yarn may also be guided through a steam nozzle before running onto the feed godet 24.

After the yarns have passed through the drawing zone, they are spread apart to the individual winding stations of the winding device after the yarn guide 29. A delivery mechanism 13 is again disposed in the yarn course between the yarn guide 21 and the head yarn guide 14. Each delivery mechanism 13 is controlled via a servomotor 34, which is coupled to a control device 32. A yarn tension sensor 31 is disposed in the yarn course between the guide 21 and the delivery mechanism 13. The sensor 31 is also connected to the control device 32. This variant of the method enables the delivery mechanisms 13 to be controlled in accordance with the tension of the yarn entering the delivery mechanisms. The control device 32 can in addition be used to predetermine a value which must without fail be observed when winding the yarn. This arrangement enables variations in the tension which may occur during the continuous process, e.g. due to wear phenomenon, to be directly corrected. The delivery mechanisms 13 do not have a predetermined setting. The tension in the yarn is therefore constantly adapted to the yarn tension required for winding in accordance with the process parameters.

Figure 3:
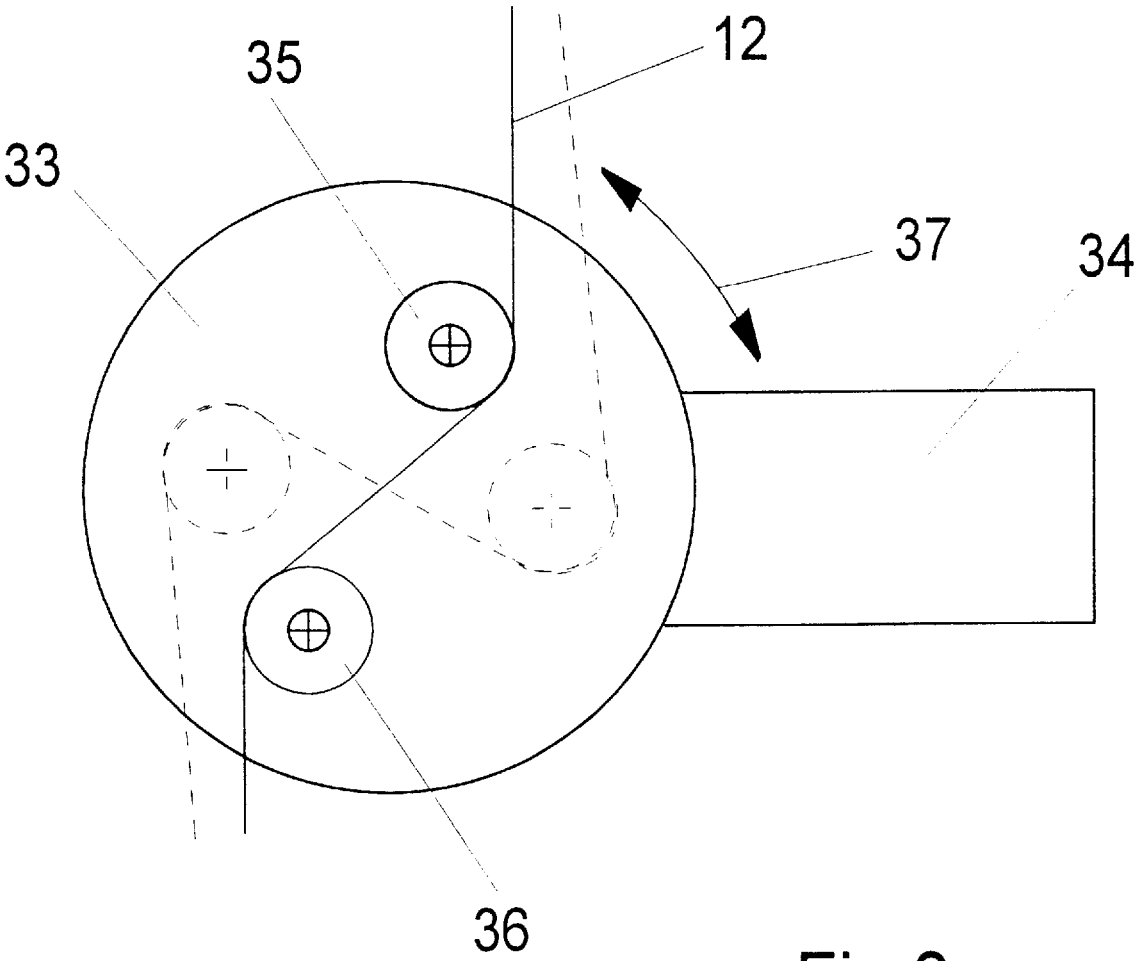
FIG. 3 is a diagrammatic view of a delivery mechanism for reducing the tension of an advancing yarn.

FIG. 3 is a diagrammatic view of a delivery mechanism 13 which enables a tension in the yarn to be reduced. The delivery mechanism comprises a disc-shaped carrier 33. The rollers 35 and 36 are rotatably mounted on the carrier 33. The rollers 35 and 36 are driven. The disc-shaped carrier 33 can be rotated in the direction of displacement 37 via the servomotor 34. The yarn 12 is guided around the rollers 35 and 36 in the shape of an S, with the yarn 12 looping around the rollers 35 and 36 to a greater or lesser degree, depending on the setting. The degree to which the yarn tension is reduced is set by varying the angle of loop at the rollers 35. The yarn tension is in this case reduced by means of a slippage which is set between the yarn and the roller 35 or 36. For this purpose the circumferential speed of the roller 35 or 36 is higher than the running-on speed of the yarn.

If a yarn tension is to be built up, the rollers 35 and 36 may be replaced by non-driven rollers or stationary pins. The friction between the yarn 12 and the respective stationary roller/pin can thus be set by the degree of looping, the result of which is a build-up of the yarn tension.

Figure 4:
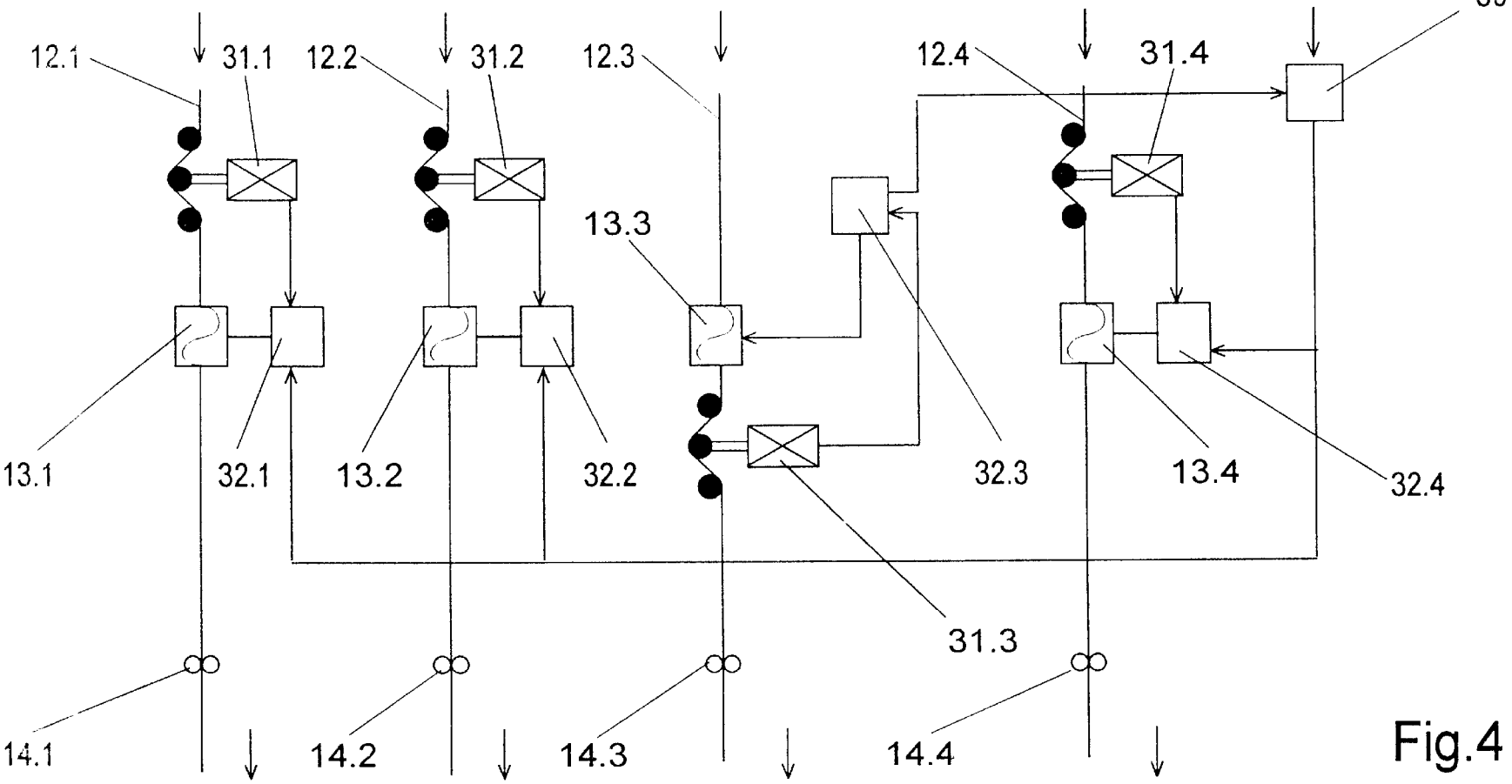
FIGS. 4 and 5 show further delivery mechanisms for setting the tension of the yarn before it enters the winding zone.
Figure 5:
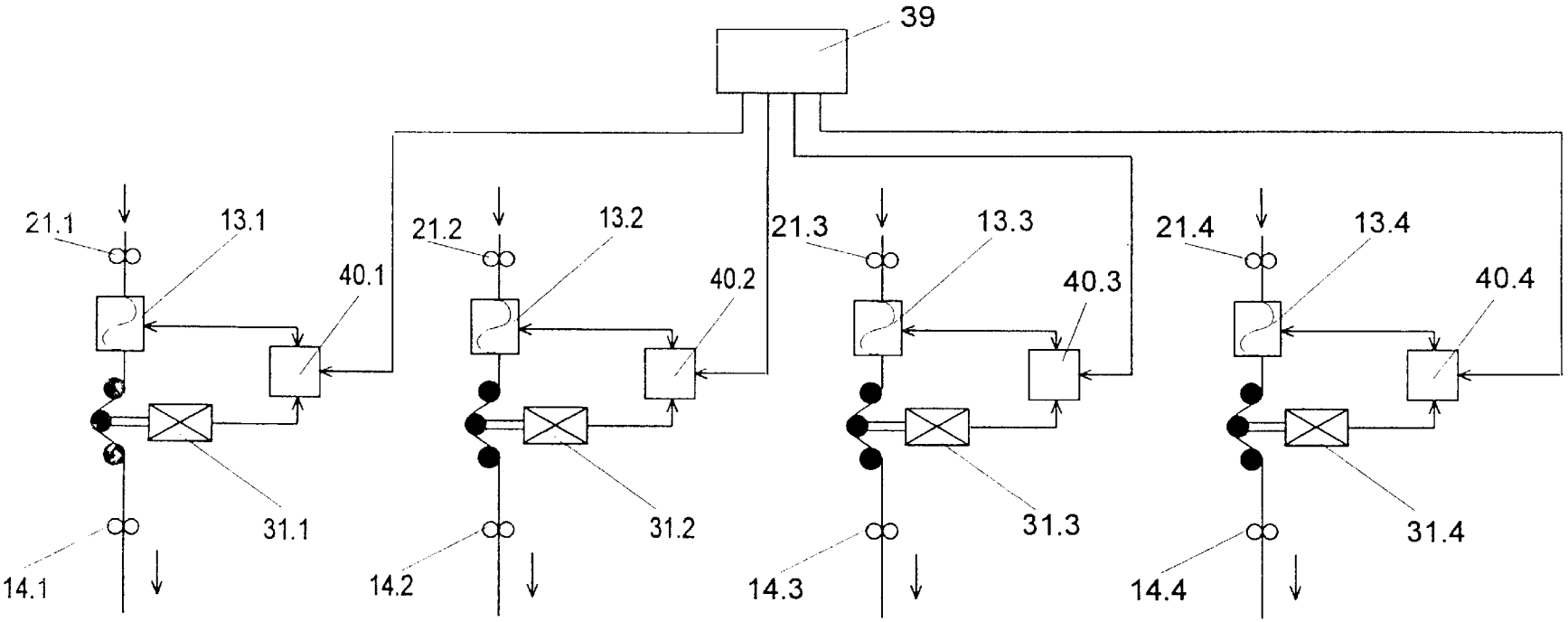

FIGS. 4 and 5 show two further modifications of the delivery mechanism, as could be used in a spinning apparatus in FIG. 1 or 2. FIG. 4 shows that the yarn tension sensors 31.1; 31.2; and 31.4 are disposed in the yarn course before the delivery mechanism 13.1; 13.2; and 13.4 and are coupled to the delivery mechanism via a control device 32.1; 32.2; and 32.4. The control devices 32.1, 32.2 and 32.4 are connected to a control unit 39. The control unit 39 is coupled to the control device 32.3. The control device 32.3 is also connected to a yarn tension sensor 31.3, the latter being disposed in the yarn course downstream of the delivery mechanism 13.3. The measurement of the yarn tension carried out on the filament 12.3 is in this case used as a reference measurement point. The measurement signal of the yarn tension sensor 31.3 is delivered via the control device 32.3 to the control unit 39. The reference signal is transmitted from the control unit 39 to the control devices 32.1, 32.2 and 32.4.

In the control device 32.1, 32.2 and 32.4 the reference signal is compared with the signal from the yarn tension measurement in the yarn course before the respective delivery mechanism. The difference is then preset as the control signal of the respective delivery mechanism. This results in the yarns 12.1, 12.2, 12.3 and 12.4 having the same yarn tension upon entering the winding zone.

FIG. 5 shows a further embodiment which, when compared with the arrangement of FIG. 2, differs in that the yarn tension sensors 31.1 to 31.4 are disposed in the yarn course downstream of the delivery mechanisms 13.1 to 13.4 instead of in the yarn course before the delivery mechanism. This arrangement is particularly suitable for regulating the yarn tension. For this purpose, the control devices 40.1 to 40.4 are in each case provided with a predetermined yarn tension by a control unit 39, this being set by way of the delivery mechanism 13.1 to 13.4. As a result of measuring the yarn tension after the delivery mechanism via the sensor 31.1 to 31.4, the measurement signal is supplied to the control device 40.1 to 40.4 and compared with the predetermined value. The differences between the predetermined value and the measured value are supplied as controlling variables to the delivery mechanism 13.1 to 13.4. This arrangement has the additional advantage of enabling variations in yarn tension resulting from the winding operation to be compensated by the delivery mechanism.

The method according to the invention is suitable for varying the tension of the yarns in a multistation spinning plant and for producing FDY, POY, BCF yarn, industrial yarn and HOY. All kinds of filament materials such as polypropylene, polyester, polyamide and viscose can likewise be processed using the method.

Figure 6:
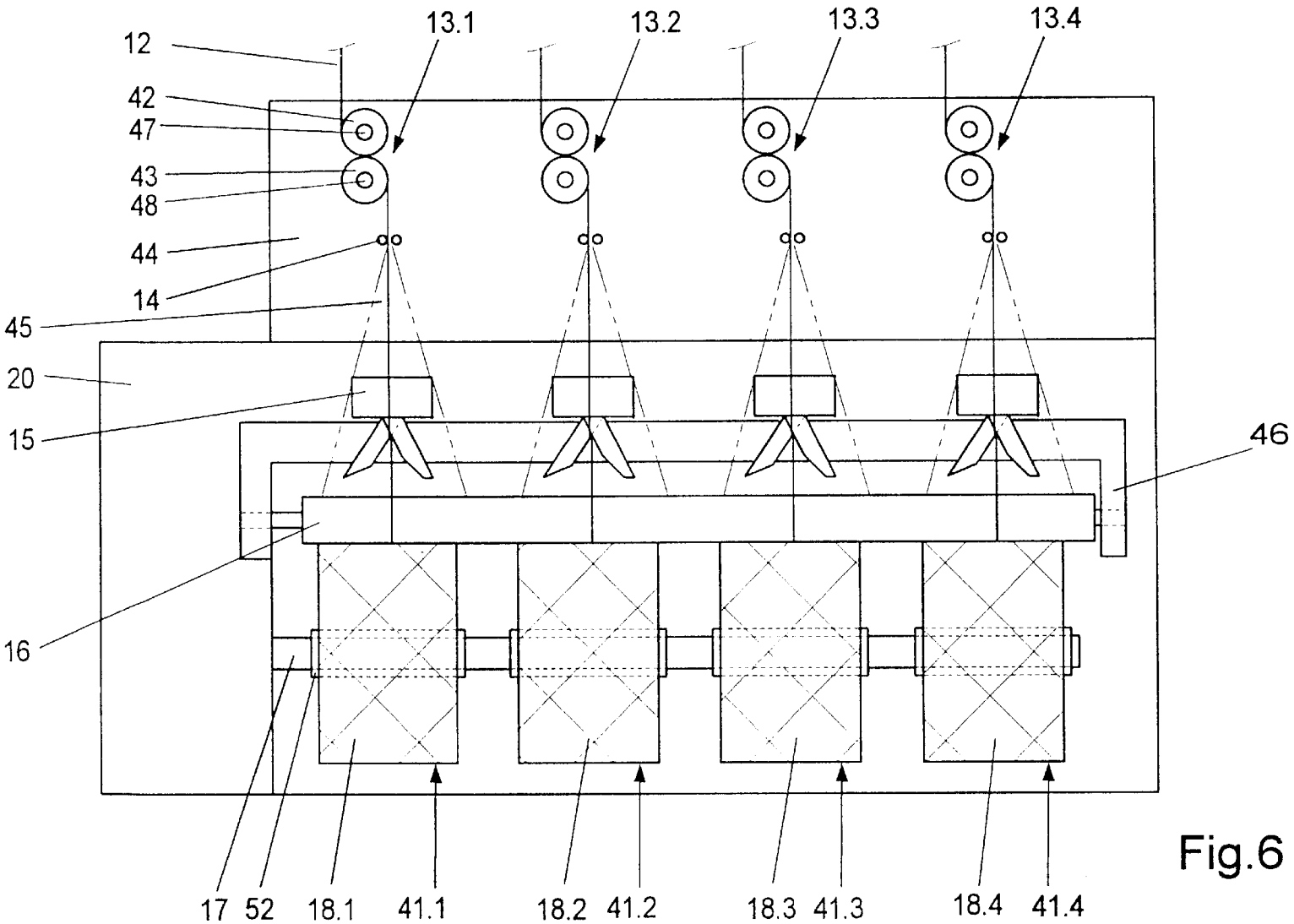
FIG. 6 is a diagrammatic side elevation view of a winding device with integrated delivery mechanisms.
Figure 7:
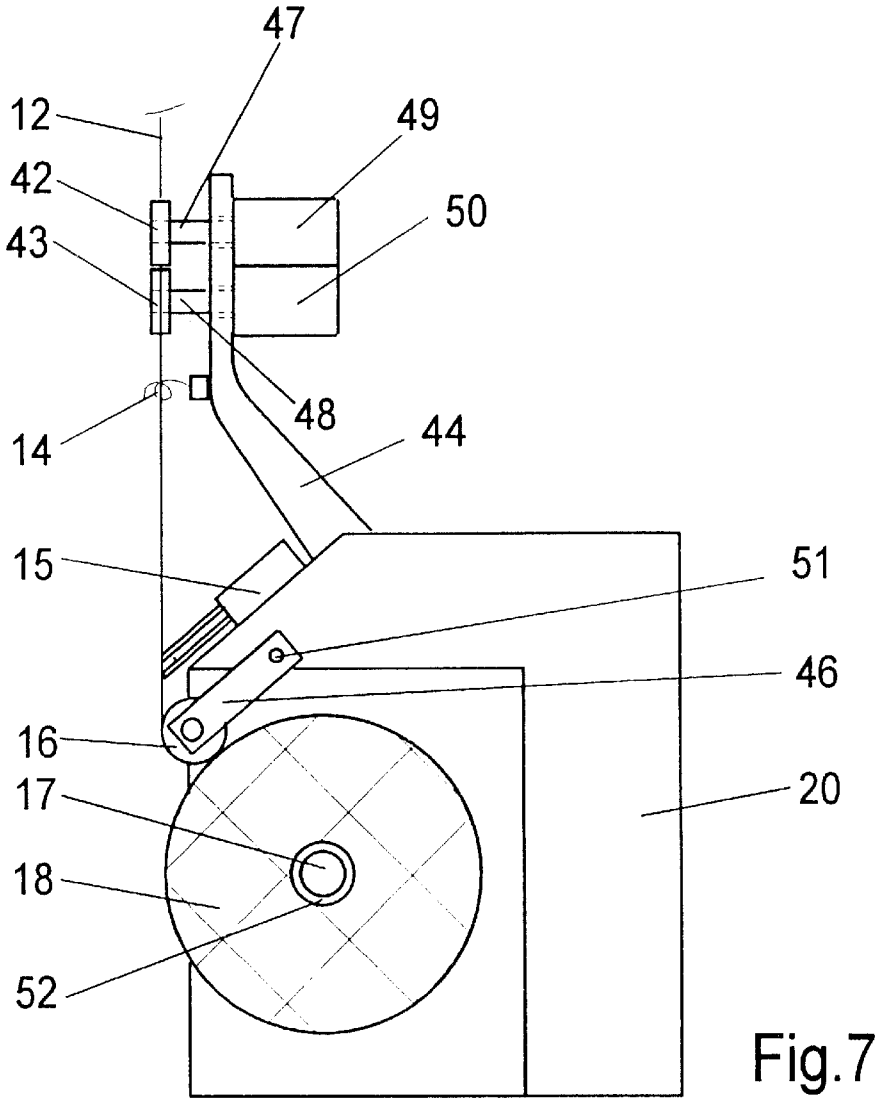
FIG. 7 is a diagrammatic front view of the winding device shown in FIG. 6.

FIGS. 6 and 7 show a winding device with integrated delivery mechanisms. In this respect the following description applies equally to FIG. 6 and FIG. 7. The winding device consists of a machine frame 20. A total of four winding stations 41.1, 41.2, 41.3 and 41.4 are disposed on the machine frame 20. Each of the winding stations 41.1 to 41.4 comprises firstly a delivery mechanism 13.1 to 13.4 in the yarn running direction. The delivery mechanisms 13.1 to 13.4 are disposed on a carrier 44, which is firmly connected to the machine frame 20. Each of the delivery mechanisms 13.1 to 13.4 comprises two delivery rollers 42 and 43 disposed one below the other. As each winding station 41.1 to 41.4 is of the same structure, the parts of the apparatus are described on the basis of one winding station in the following. The delivery roller 42 is connected to a drive shaft 47, which is driven by a motor 49. The delivery roller 43 is secured to the drive shaft 48, which is driven by the motor 50. The yarn 12 loops around the delivery rollers 42 and 43 in the shape of a Z.

A head yarn guide 14 and, following this, a traversing device 15 are disposed below the delivery mechanisms 13.1 to 13.4. The so-called traversing triangle 45 is formed between the head yarn guide 14 and the traversing device 15. The traversing device 15 is in this case formed as a vane-type traversing device, with the yarn being guided to and fro within a traversing stroke by two or more vanes driven in opposite directions. At the end of each traversing stroke the transfer takes place between two vanes meeting at a transfer point. A pressure roll 16 is mounted to a rocker arm 46 below the traversing device 15. The pressure roll 16 lies on the surface of the package 18 with a predetermined force. The package 18 is wound on a tube 52, which is mounted on a winding spindle 17. The winding spindle 17 is rotatably mounted in a projecting manner in the machine frame 19.

The yarn 12 entering the winding station 41.1 initially enters the delivery mechanism 13.1. The delivery rollers 42 and 43 of the delivery mechanism 13.1 are driven at a circumferential speed which is higher than the yarn speed. This results in a certain reduction in the tension in the filament. The reduction in tension is in this case essentially determined by the circumferential speed which is set. The angles of loop at the delivery rollers are fixed at a predetermined value in this embodiment. The yarn then enters the traversing triangle and is deposited on the package 18 by means of the traversing device 15 and the pressure roll 16. The circumferential speed of the package 18 is constant in this case. The circumferential speed of the package is regulated by way of a spindle motor, which is controlled in accordance with the rotational speed of the pressure roll.

In order to permit a continuous winding process, the winding spindle 17 can be mounted in a revolver (not shown) as disclosed for example in U.S. Pat. Nos. 5,029,762 and 5,526,995. The revolver is rotatably disposed in the machine frame, and a second winding spindle is disposed on the revolver such that it is staggered by 180° with respect to the first winding spindle. As soon as the packages 18 on the winding spindle 17 have been completely wound, the winding revolver is rotated, so that the second spindle, with empty bobbin tubes mounted thereon, is pivoted into the appropriate operating position.

The winding device shown in FIGS. 6 and 7 could be used in the spinning apparatus from FIG. 1 or 2. It is, however, also possible to use a winding device of this kind in a spinning plant in which the filaments lie in a parallel course between the spinneret and the winding stations.

Figure 8:
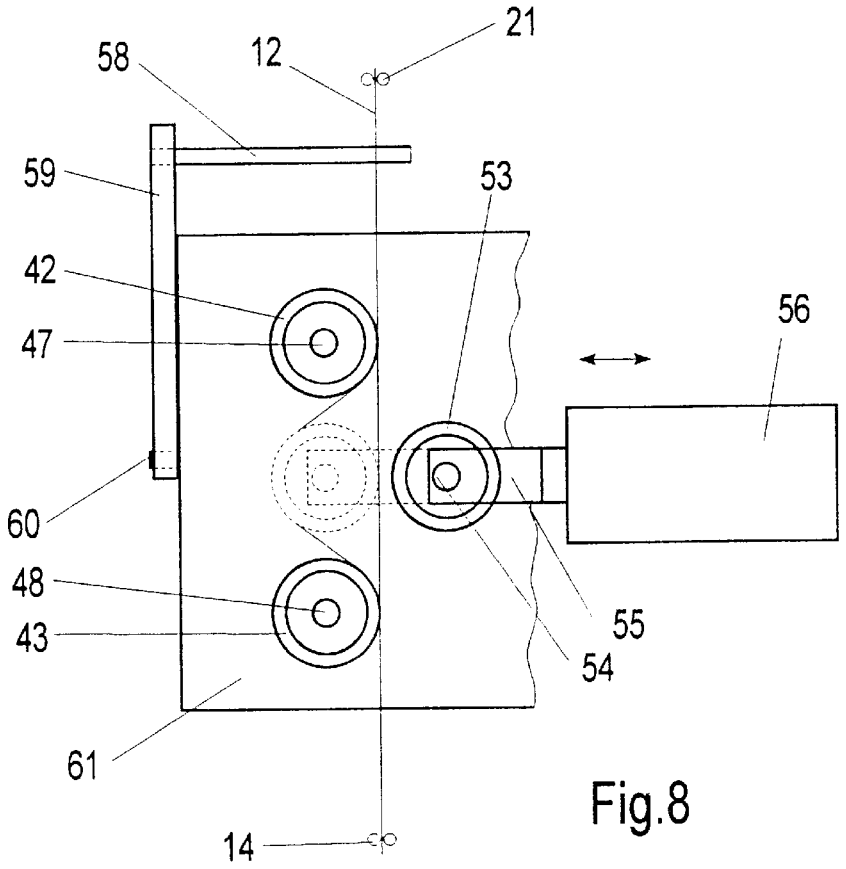
FIG. 8 is a diagrammatic front view of a delivery mechanism with three delivery rollers.

FIG. 8 shows another embodiment of a delivery mechanism as could be used in the spinning apparatus from FIGS. 1 and 2 or in a winding device according to FIG. 6. Here the delivery mechanism consists of three delivery rollers 42, 43 and 53. The delivery rollers 42 and 43 are disposed at a distance from one another parallel to the course of the yarn 12. The delivery roller 42 is driven by the drive shaft 47 and the delivery roller 43 by the drive shaft 48. The delivery roller 53 is connected to a drive shaft 54, which is mounted in a fork 55. The fork 55 is disposed on an actuator 56, so that the fork 55 can be displaced essentially transversely to the yarn running direction. The delivery roller 53 is disposed on the opposite side of the yarn course with respect to the delivery rollers 42 and 43. In the illustrated position, the actuator 56 with the delivery roller 53 is shown in the drawn-in state and hence moved out of the yarn course. The yarn 12 can now pass unobstructed through the delivery mechanism without looping. The delivery roller 53 is positioned in the center between the delivery rollers 42 and 43. As the distance between the delivery rollers 42 and 43 is greater than the diameter of the roller 53, the roller 53 can be advanced into the space between the delivery rollers 42 and 43 by means of the actuator 56. The delivery roller 53 then passes through the plane of the yarn course, so that the yarn 12 is forcibly guided by the delivery roller 53 and loops partly around each of the delivery rollers 42, 43 and 53. This position is shown by broken lines in FIG. 8. The delivery roller 53 can be adjusted to a variable degree, so that different angles of loop can be set.

The delivery rollers 42, 43 and 53 are provided on a carrier 61. A yarn lifting device, which comprises a swivel arm 59 and a yarn guide 58, is secured to the side of the carrier 61. The swivel arm 58 is mounted at the pivot pin 60. The yarn guide 58 passes through the plane of the yarn course with its free end. The yarn 12 is thus taken up by the yarn guide 58 when the swivel arm is pivoted in the direction moving out of the plane of the drawing.

Figure 9:
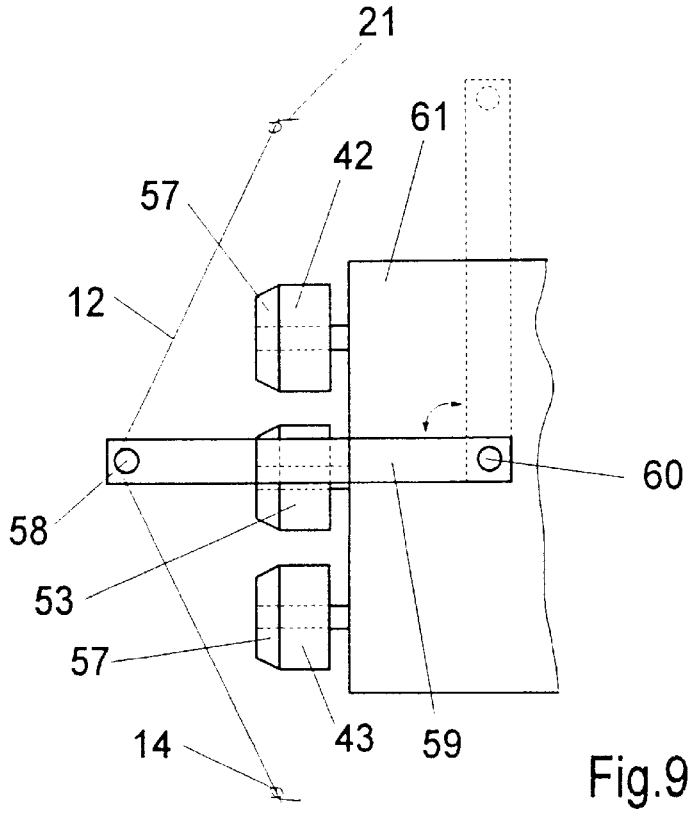
FIG. 9 is a diagrammatic side view of the delivery mechanisms from FIG. 8 with a filament lifting apparatus.

FIG. 9 is a diagrammatic side view of the delivery mechanism from FIG. 8. Here the delivery rollers 42, 43 and 53 are mounted on a carrier 61. The delivery rollers 42, 43 and 53 each include a conical feed slope 57 at the free end which is opposite the carrier 61, and which assists the yarn thread up. The swivel arm 59 is also mounted such that it can pivot at the pivot pin 60 on the carrier 61. The yarn guide 58 is secured to the free end of the swivel arm 59. The yarn guide 58 passes through the plane of the yarn course. In the operating position the swivel arm extends parallel to the yarn running direction. In this situation the yarn 12 is guided via the yarn guide 21 through the delivery mechanism to the yarn guide 14. If the swivel arm 59 is now pivoted in the direction of the yarn 12, it passes through the plane of the yarn course, so that the yarn is lifted out of the delivery mechanism after being pivoted through 90° by the yarn guide 58. The swivel arm is pivoted back into its starting position when the yarn is fed into the delivery mechanism. The yarn 12 then automatically slides into the region of the delivery rollers 42 and 43.

Figure 10:
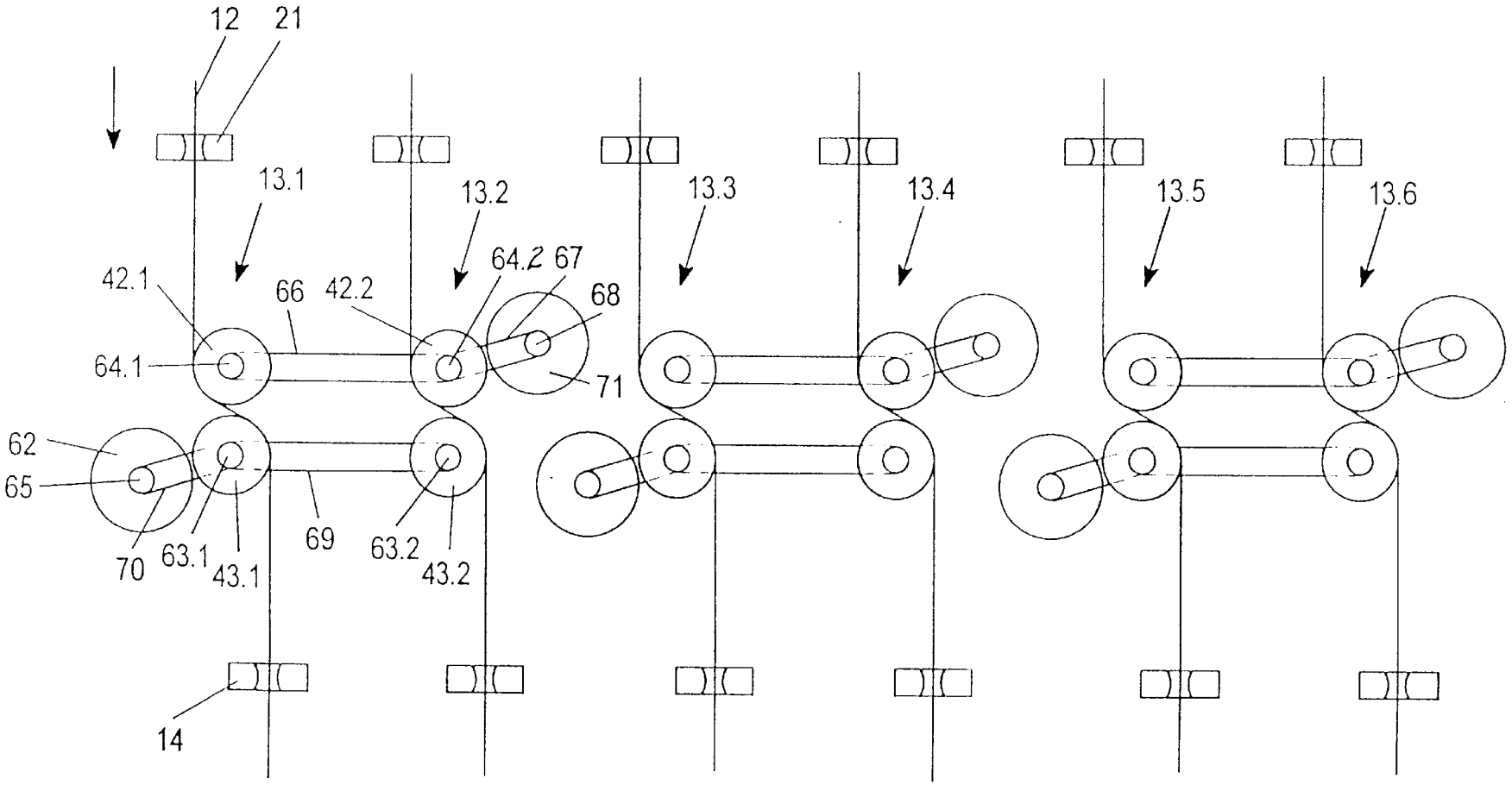
FIG. 10 is a diagrammatic view of an arrangement of delivery mechanisms with a group drive.

FIG. 10 is a diagrammatic view of another arrangement of delivery mechanisms as could be used in the spinning apparatus from FIG. 1 or 2. A total of six delivery mechanisms 13.1 to 13.6 are disposed side by side. Here again each of the delivery mechanisms is formed by two delivery rollers, as described previously in relation to FIG. 6. As illustrated in FIG. 10, the delivery rollers 42.1; 42.2 and 43.1; 43.2 are each secured to a shaft 64.1; 64.2 and 63.1; 63.2, respectively. In this case the top delivery rollers 42.1 and 42.2 of adjacent delivery mechanisms 13.1 and 13.2 are connected together via a belt 66. One of the drive shafts 64.2 of the delivery roller 42.2 is then driven via a belt drive 67. The belt drive 67 is here connected with a drive shaft 68, which is driven by a motor 71. The belt 67 loops around the shaft 64.2 and the drive shaft 68.

The bottom delivery rollers 43.1; 43.2 of the adjacent delivery mechanisms 13.1 and 13.2 are connected together via a belt 69 which loops about the drive shafts 63.1; 63.2. The drive shaft 63.1 of the roller 43.1 is in turn driven by a belt 70 which loops about the drive shaft 65 of the motor 62.

In the arrangement shown in FIG. 10 two delivery rollers are in each case driven together by one drive. However it is also possible to drive several delivery rollers with just one drive, although this kind of coupling of the delivery roller drives is only appropriate if the tension in the yarns before they enter the delivery mechanisms are essentially at the same level.

The delivery mechanisms 13.3 and 13.4 as well as the delivery mechanisms 13.5 and 13.6 are also driven in the manner described above with reference to the delivery mechanisms 13.1 and 13.2.

In the drawings and specification, there has been set forth a preferred embodiment of the invention, and although specific terms are employed, they are used in a generic and descriptive sense only and not for purposes of limitation.

That which is claimed is:

1. A method of spinning a plurality of polymeric yarns and winding the same into respective yarn packages, comprising the steps of:

extruding a polymeric material so as to form a plurality of advancing bundles of filaments, gathering the bundles of extruded filaments so as to form advancing yarns therefrom, winding the advancing yarns into respective packages which are coaxially mounted on a winding spindle, and separately controlling the yarn tension of each of the advancing yarns immediately upstream of the winding step and comprising advancing each yarn into contact with a separate yarn delivery mechanism which includes at least one rotating roller, and looping the advancing yarn about at least a portion of the circumferential periphery of the one rotating roller.

2. The method as defining claim 1 wherein the step of separately controlling the yarn tension of each of the advancing yarns includes adjusting the yarn tension of each of the advancing yarns so as to be substantially the same.

3. The method as defined in claim 1 comprising the further step of drawing all of the advancing yarns before the step of separately controlling the yarn tension of each of the advancing yarns.

4. The method as defined in claim 1 wherein the step of separately controlling the yarn tension of each of the advancing yarns comprises advancing each yarn into contact with a separate yarn delivery mechanism which includes two driven rollers, and including looping the advancing yarn about the two driven rollers in the configuration of an S or a Z, and adjusting the looping of the yarn by varying the position of at least one of the rollers relative to the yarn course.

5. The method as defined in claim 1 wherein the step of separately controlling the yarn tension of each of the advancing yarns comprises advancing each yarn into contact with a separate yarn delivery mechanism which includes two non-driven rollers, and including looping the advancing yarn about the two non-driven rollers in the configuration of an S or a Z, and adjusting the looping of the yarn by varying the position of at least one of the rollers relative to the yarn course.

6. The method as defined in claim 1 wherein the step of separately controlling the yarn tension of each of the advancing yarns further comprises adjusting the yarn tension of each of the yarns by contact with the associated yarn delivery mechanism so that the tension of each of the yarns before the yarn delivery mechanism is lower than the tension after the yarn delivery mechanism.

7. The method as defined in claim 1 wherein the step of separately controlling the yarn tension of each of the advancing yarns further comprises measuring the yarn tension in each of the yarns and controlling the tension in each of the yarns before the associated yarn delivery mechanism.

8. The method as defined in claim 1 wherein the step of separately controlling the yarn tension of each of the advancing yarns further comprises measuring the yarn tension in each of the yarns and controlling the tension in each of the yarns downstream of the delivery mechanism.

9. The method as defined in claim 1 wherein the step of separately controlling the yarn tension of each of the advancing yarns further comprises measuring the yarn tension in each of the advancing yarns before or after the delivery mechanism, and adjusting the delivery mechanism in accordance with the difference between a reference tension and the measured tension.

10. The method as defined in claim 9 wherein the reference tension is determined by the yarn tension of a selected one of the advancing yarns.

11. The method as defined in claim 9 wherein the reference tension is a predetermined value.

12. An apparatus for spinning a plurality of polymeric yarns and winding the same into respective yarn packages, comprising an extruder for spinning a plurality of multifilament polymeric yarns, and so that the yarns advance downwardly in a side by side arrangement which extends in a longitudinal direction, a winder for winding the advancing yarns onto respective bobbin tubes which are coaxially mounted on a longitudinally extending winding spindle, and a plurality of yarn delivery mechanisms positioned upstream of the winder, with the mechanisms operatively associated with respective ones of the yarns, for separately controlling the yarn tension of each of the yarns before reaching the winder, and wherein each of the yarn deliver mechanisms comprises a driven delivery roller positioned so that the associated yarn partly loops about the roller.

13. The apparatus as defined in claim 12 further comprising a plurality of yarn guides positioned upstream of the winder for guiding the yarns downwardly to the winder in parallel directions and so that the parallel yarns define a longitudinally extending plane.

14. The apparatus as defined in claim 13 wherein the yarn delivery mechanisms are positioned side by side in the longitudinally extending plane.

15. The apparatus as defined in claim 14 wherein said winder includes a yarn traversing mechanism for each advancing yarn so as to form a cross-wound package on the respective bobbin tubes, with each yarn traversing mechanism including a fixed yarn guide which forms the apex of a traversing triangle for the associated yarn.

16. The apparatus as defined in claim 15 wherein the yarn delivery mechanisms are positioned upstream of the fixed yarn guides.

17. The apparatus as defined in claim 12 further comprising drawing roll means disposed between the extruder and the yarn delivery mechanisms for drawing each of the advancing yarns.

18. The apparatus as defined in claim 12 wherein each of the yarn delivery mechanisms comprises a pair of driven delivery rollers positioned so that the associated yarn serially advances from one roller to the other roller and partly loops about each roller.

19. The apparatus as defined in claim 12 wherein each of said yarn delivery mechanisms comprises three driven delivery rollers positioned so that the associated yarn serially advances across and partly loops about each of the rollers.

20. The apparatus as defined in claim 19 wherein an intermediate one of said rollers is mounted for selective lateral movement into and out of the course of the associated yarn.

21. The apparatus as defined in claim 20 wherein the three delivery rollers are positioned such that when the one roller is moved out of the course of the associated yarn, the advancing yarn does not contact the other two rollers.

22. The apparatus as defined in claim 20 wherein each of the three delivery rollers includes a conical feed surface at the free axial end thereof.

23. The apparatus as defined in claim 18 wherein the pair of delivery rollers are independently driven by individual motors.

24. The apparatus as defined in claim 12 wherein each of the yarn delivery mechanisms comprises at least one driven delivery roller, and wherein the one driven delivery roller of adjacent yarn delivery mechanisms are driven by a common drive.

25. The apparatus as defined in claim 12 wherein the plurality of yarn delivery mechanisms are operatively connected to a central control unit.

26. The apparatus as defined in claim 25 wherein each of the yarn delivery mechanisms includes a yarn tension sensor with each yarn tension sensor delivering a signal to said control unit.

27. The apparatus as defined in claim 12 wherein each of the yarn delivery mechanisms includes a yarn tension sensor and a control device, and wherein the signal from the tension sensor is delivered to the associated control device.

28. The apparatus as defined in claim 12 wherein each of the yarn delivery mechanisms includes a tension controlling device which is engaged by the running yarn and a yarn tension sensor which engages the running yarn.

29. The apparatus as defined in claim 28 wherein the tension sensor of each yarn delivery mechanism is positioned between the tension controlling device and the winder.

* * * * *